US007803205B2

(12) United States Patent
Oh et al.

(10) Patent No.: US 7,803,205 B2
(45) Date of Patent: Sep. 28, 2010

(54) MULTI-CYCLONE DUST SEPARATING APPARATUS HAVING A FILTER ASSEMBLY

(75) Inventors: Jang-keun Oh, Gwangju (KR); Min-ha Kim, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 544 days.

(21) Appl. No.: 11/882,036

(22) Filed: Jul. 30, 2007

(65) Prior Publication Data

US 2008/0184893 A1 Aug. 7, 2008

(30) Foreign Application Priority Data

Feb. 5, 2007 (KR) ..... 10-2007-0011670

(51) Int. Cl.
*B01D 45/12* (2006.01)

(52) U.S. Cl. ..... 55/337; 55/343; 55/349; 55/429; 55/459.1; 55/503; 55/DIG. 3; 96/416

(58) Field of Classification Search ..... 55/337, 55/343, 349, 426, 429, 459.1, 486, 503; 96/416; 15/350, 353
See application file for complete search history.

(56) References Cited

U.S. PATENT DOCUMENTS

| | | | |
|---|---|---|---|
| 1,207,034 | A | 12/1916 | Harsant |
| 1,416,885 | A | 5/1922 | Schreiner |
| 1,416,995 | A | 5/1922 | Stroud |
| 2,539,257 | A | 1/1950 | Limberg |
| 2,511,387 | A | 6/1950 | Watson et al. |
| 2,539,195 | A | 1/1951 | Lang |
| 2,553,175 | A | 5/1951 | Davenport et al. |
| 3,046,718 | A | 7/1962 | Ide et al. |
| 3,078,650 | A | 2/1963 | Anderson |
| 3,425,192 | A | 2/1969 | Davis |
| 3,769,781 | A | 11/1973 | Klein et al. |
| 3,898,068 | A | 8/1975 | McNeil |
| 4,373,228 | A | 2/1983 | Dyson |
| 4,826,515 | A | 5/1989 | Dyson |
| 4,853,008 | A | 8/1989 | Dyson et al. |
| 5,078,761 | A | 1/1992 | Dyson |
| 5,145,499 | A | 9/1992 | Dyson et al. |
| 5,160,356 | A | 11/1992 | Dyson |
| 5,163,786 | A | 11/1992 | Christianson |
| 5,254,147 | A | 10/1993 | Finke |
| 5,307,538 | A | 5/1994 | Rench et al. |
| 6,171,356 | B1 | 1/2001 | Twerdun et al. |
| 6,238,451 | B1 | 5/2001 | Conrad et al. |

(Continued)

FOREIGN PATENT DOCUMENTS

| | | |
|---|---|---|
| CN | 87205753 | 10/1987 |

(Continued)

*Primary Examiner*—Robert A Hopkins
(74) *Attorney, Agent, or Firm*—Blank Rome LLP

(57) ABSTRACT

A multi-cyclone dust separating apparatus includes a cyclone unit and a separable filter assembly adapted to be disposed at least partially in a discharge path of the cyclone unit. The cyclone unit includes a main cyclone, a secondary cyclone adapted to be disposed at substantially a same plane as the main cyclone, and a dust collecting casing adapted to substantially surround the main cyclone and the secondary cyclone. The dust collecting casing includes a dust chamber to collect dust separated at the main cyclone and the secondary cyclone.

14 Claims, 7 Drawing Sheets

U.S. PATENT DOCUMENTS

| | | | | |
|---|---|---|---|---|
| 6,264,712 | B1 | 7/2001 | Decker | |
| 6,269,518 | B1 | 8/2001 | Yung | |
| 6,334,234 | B1 | 1/2002 | Conrad et al. | |
| 6,368,373 | B1 | 4/2002 | Mueller | |
| 6,428,589 | B1 | 8/2002 | Bair et al. | |
| 6,431,404 | B1 | 8/2002 | Long, Jr. | |
| 6,436,160 | B1 | 8/2002 | Stephens et al. | |
| 6,582,489 | B2 | 6/2003 | Conrad | |
| 6,607,572 | B2 | 8/2003 | Gammack et al. | |
| 6,625,845 | B2 | 9/2003 | Matsumoto et al. | |
| 6,740,144 | B2 | 5/2004 | Conrad et al. | |
| 6,746,500 | B1 | 6/2004 | Park et al. | |
| 6,766,558 | B1 | 7/2004 | Matsumoto et al. | |
| 6,829,804 | B2 | 12/2004 | Sepke | |
| 7,097,680 | B2 | 8/2006 | Oh | |
| 7,140,068 | B1 | 11/2006 | Vander Baan et al. | |
| 7,169,201 | B2 | 1/2007 | Oh et al. | |
| 7,267,704 | B2 * | 9/2007 | Allgeier | 55/429 |
| 2001/0005983 | A1 | 7/2001 | Berfield et al. | |
| 2001/0005986 | A1 | 7/2001 | Matsubara et al. | |
| 2001/0025395 | A1 | 10/2001 | Matsumoto et al. | |
| 2001/0054213 | A1 | 12/2001 | Oh et al. | |
| 2002/0011053 | A1 | 1/2002 | Oh | |
| 2002/0020154 | A1 | 2/2002 | Yang | |
| 2002/0066366 | A1 | 6/2002 | Conrad et al. | |
| 2003/0067765 | A1 | 4/2003 | Li | |
| 2004/0010885 | A1 | 1/2004 | Hitzelberger et al. | |
| 2004/0025285 | A1 | 2/2004 | McCormick et al. | |
| 2004/0074041 | A1 | 4/2004 | Overvaag | |
| 2004/0098958 | A1 | 5/2004 | Roth et al. | |
| 2004/0103785 | A1 | 6/2004 | North | |
| 2004/0194250 | A1 | 10/2004 | Conrad et al. | |
| 2005/0050678 | A1 | 3/2005 | Oh et al. | |
| 2005/0132529 | A1 | 6/2005 | Davidshofer | |
| 2005/0252180 | A1 | 11/2005 | Oh et al. | |
| 2006/0123590 | A1 | 6/2006 | Fester et al. | |
| 2006/0230715 | A1 | 10/2006 | Oh et al. | |
| 2006/0277712 | A1 | 12/2006 | Kim et al. | |
| 2007/0095028 | A1 * | 5/2007 | Kim et al. | 55/337 |
| 2007/0289266 | A1 * | 12/2007 | Oh | 55/337 |

FOREIGN PATENT DOCUMENTS

| | | | |
|---|---|---|---|
| CN | 2087999 | | 11/1991 |
| CN | 1067295 | | 12/1992 |
| CN | 22550815 | Y | 2/1997 |
| CN | 1296801 | A | 5/2000 |
| CN | 1361673 | | 7/2000 |
| CN | 2518598 | | 10/2002 |
| CN | 1389175 | | 1/2003 |
| CN | 2530580 | | 1/2003 |
| CN | 1422187 | | 6/2003 |
| CN | 1426745 | | 7/2003 |
| CN | 1434688 | | 8/2003 |
| DE | 1282872 | | 11/1968 |
| DE | 2811536 | | 11/1978 |
| DE | 1336829 | | 11/1979 |
| DE | 29908567 | U1 | 1/2000 |
| DE | 20102723 | | 6/2001 |
| DE | 10132690 | | 7/2002 |
| DE | 20306405 | | 10/2003 |
| DE | 10110581 | C2 | 11/2003 |
| DE | 102004028677 | | 3/2005 |
| DE | 102004028675 | | 4/2005 |
| DE | 102004028676 | | 4/2005 |
| DE | 102004030600 | | 9/2005 |
| EP | 0095354 | | 11/1983 |
| EP | 0923992 | A2 | 6/1999 |
| EP | 1199023 | A1 | 4/2002 |
| EP | 1362543 | | 11/2003 |
| EP | 1726245 | A2 | 11/2006 |
| EP | 1733671 | A2 | 12/2006 |
| EP | 1779761 | A2 | 5/2007 |
| ES | 2105467 | | 10/1997 |
| ES | 2196837 | | 12/2003 |
| FR | 2619498 | | 2/1989 |
| FR | 2859370 | | 3/2005 |
| GB | 835884 | | 5/1960 |
| GB | 1107045 | | 3/1968 |
| GB | 1207034 | | 9/1970 |
| GB | 2317122 | | 3/1998 |
| GB | 2326360 | | 12/1998 |
| GB | 2360719 | | 10/2001 |
| GB | 2374305 | | 10/2002 |
| GB | 2375980 | | 12/2002 |
| GB | 2376176 | | 12/2002 |
| GB | 2377656 | | 1/2003 |
| GB | 2381484 | | 5/2003 |
| GB | 2406065 | | 3/2005 |
| JP | 50101012 | | 8/1975 |
| JP | S5214775 | | 2/1977 |
| JP | SHO 53-141859 | | 11/1978 |
| JP | 09-234174 | | 9/1997 |
| JP | 09234174 | | 9/1997 |
| JP | 2002051951 | | 2/2002 |
| JP | 2002143052 | | 5/2002 |
| JP | 2002172077 | | 6/2002 |
| JP | 2002326041 | | 11/2002 |
| JP | 2003024826 | | 1/2003 |
| JP | 2003116752 | | 4/2003 |
| JP | 2004357767 | A | 12/2004 |
| KR | 1019930000527 | B1 | 1/1993 |
| KR | 19930021001 | | 10/1993 |
| KR | 1020030032497 | A | 4/2003 |
| KR | 1020040017195 | A | 2/2004 |
| KR | 10-2004-0075573 | | 8/2004 |
| KR | 1020040099980 | | 12/2004 |
| KR | 10-2006-0040779 | | 5/2006 |
| KR | 100648960 | | 11/2006 |
| RU | 2137530 | | 9/1999 |
| RU | 2174452 | | 10/2001 |
| RU | 2206029 | | 6/2003 |
| WO | WO-99/42198 | | 8/1999 |
| WO | WO-0044272 | | 8/2000 |
| WO | WO-00/64321 | | 11/2000 |
| WO | WO-00/74547 | | 12/2000 |
| WO | WO-00/74548 | | 12/2000 |
| WO | WO-01/60524 | A1 | 8/2001 |
| WO | WO-0174493 | | 10/2001 |
| WO | WO-0195780 | | 12/2001 |
| WO | WO-02067750 | | 9/2002 |
| WO | WO-02067756 | | 9/2002 |
| WO | WO-03030702 | | 4/2003 |

* cited by examiner

MULTI-CYCLONE DUST SEPARATING APPARATUS HAVING A FILTER ASSEMBLY

CROSS-REFERENCES TO RELATED APPLICATIONS

This application claims the benefit of priority under 35 U.S.C. §119(a) from Korean Patent Application No. 2007-11670 filed on Feb. 5, 2007 in the Korean Intellectual Property Office, the disclosure of which is incorporated herein by reference in its entirety.

This application may be related to the copending U.S. patent application Ser. No. 10/840,248, filed May 7, 2004 entitled "Cyclone Separating Apparatus and a Vacuum Cleaner Having the Same" by Jang-Keun Oh et al., the entire disclosure of which is incorporated herein by reference.

This application may be related to the copending U.S. patent application Ser. No. 10/840,230, filed May 7, 2004 entitled "Cyclone Separating Apparatus and a Vacuum Cleaner Having the Same" by Jang-Keun Oh et al., the entire disclosure of which is incorporated herein by reference.

This application may be related to the copending U.S. patent application Ser. No. 10/840,231, filed May 7, 2004 entitled "Cyclone Dust Separating Apparatus and Vacuum Cleaner Having the Same" by Jang-Keun Oh et al., the entire disclosure of which is incorporated herein by reference.

This application may be related to the copending U.S. patent application Ser. No. 10/851,114, filed May 24, 2004 entitled "Cyclone Dust Collecting Device for Vacuum Cleaner" by Jang-Keun Oh et al., the entire disclosure of which is incorporated herein by reference.

This application may be related to the copending U.S. patent application Ser. No. 10/874,257, filed Jun. 24, 2004 entitled "Cyclone Dust Collecting Apparatus for a Vacuum Cleaner" by Jang-Keun Oh et al., the entire disclosure of which is incorporated herein by reference.

This application may be related to the copending U.S. patent application Ser. No. 11/137,506, filed May 26, 2005 entitled "Vacuum Cleaner Dust Collecting Apparatus" by Jung-Gyun Han et al., the entire disclosure of which is incorporated herein by reference.

This application may be related to the copending U.S. patent application Ser. No. 11/206,878, filed Aug. 19, 2005 entitled "Dust Collecting Apparatus of a Vacuum Cleaner" by Ji-Won Seo et al., the entire disclosure of which is incorporated herein by reference.

This application may be related to the copending U.S. patent application Ser. No. 11/203,990, filed Aug. 16, 2005 entitled "Dust-Collecting Apparatus and Method for a Vacuum Cleaner" by Ji-Won Seo et al., the entire disclosure of which is incorporated herein by reference.

This application may be related to the copending U.S. patent application Ser. No. 11/281,732, filed Nov. 18, 2005 entitled "Dust Collecting Apparatus for a Vacuum Cleaner" by Jung-Gyun Han et al., the entire disclosure of which is incorporated herein by reference.

This application may be related to the copending U.S. patent application Ser. No. 11/315,335, filed Dec. 23, 2005 entitled "Multi-Cyclone Dust Separating Apparatus" by Dong-Yun Lee et al., the entire disclosure of which is incorporated herein by reference.

This application may be related to the U.S. Pat. No. 7,097,680, granted Aug. 29, 2006 entitled "Cyclone Separating Apparatus and Vacuum Cleaner Equipped with the Same" by Jang-Keun Oh, the entire disclosure of which is incorporated herein by reference.

FIELD OF THE INVENTION

The present invention relates to a vacuum cleaner. More particularly, the present invention relates to a multi-cyclone dust separating apparatus for a vacuum cleaner.

BACKGROUND OF THE INVENTION

Generally, a vacuum cleaner includes a bottom brush to draw in air and dust from the surface being cleaned, a motor driving chamber with a vacuum source, and a cyclone separating apparatus. The term "dust" will be used herein to refer collectively to dust, dirt, particulates, debris, contaminants, and other similar matter that can be entrained with the air suctioned by the vacuum cleaner.

After the air is drawn through the bottom brush, the cyclone separating apparatus is configured to whirl the dust-laden air, separate the dust from the air by centrifugal force, and then discharge the clean air via the motor driving chamber. Also, the vacuum cleaner can have a multi-cyclone separating apparatus instead of the cyclone separating apparatus.

The multi-cyclone separating apparatus has a main cyclone and one or more secondary cyclones. The main cyclone and the secondary cyclones separate dust from the air in two or more stages. An example of the conventional multi-cyclone dust separating apparatus is described in International Patent Publication Nos. WO 02/067755 and WO 02/067756, both by Dyson. However, the conventional multi-cyclone dust separating apparatus is arranged such that the downstream secondary cyclone is placed vertically with respect to the upstream main cyclone. Thus, the conventional multi-cyclone dust separating apparatus has a height more appropriate for an upright type cleaner but unsuitable for a canister type cleaner.

The overall height of the multi-cyclone dust separating apparatus can be reduced by placing the secondary cyclone near the outer circumference of the main cyclone as described in Korean Patent No. 554237. However, since shorter vacuum cleaners generally have smaller dust separating apparatuses, the user has to empty the dust separating apparatus more frequently.

To resolve the above problem, a multi-cyclone dust separating apparatus with increased dust holding capacity has been developed, as described in Korean Patent No. 648960. The multi-cyclone dust separating apparatus of Korean Patent No. 648960 reduces the overall height and thus can be used with both the upright type vacuum cleaner and the canister type vacuum cleaner. However, the multi-cyclone dust separating apparatus of Korean Patent No. 648960 continuously receives unfiltered air with small dust particles and is eventually affected by the dust. A suction motor causes air to pass sequentially through the main cyclone and a plurality of secondary cyclones. As the air passes through the cyclones, the dust is separated from the air and collected in a space defined at the lower portion of the separating apparatus. The air is then discharged directly, through an air discharge port, without passing through a separate filter. As a result, the suction motor continuously receives unfiltered air and is eventually affected by the dust.

Also, to increase the small dust filtering efficiency, a dust separating apparatus is provided with a filter, as described in Korean Patent Publication No. 2006-13855 and Korean Patent No. 623916. The dust separating apparatus of Korean Patent Publication No. 2006-13855 has a filter that is placed within the dust separating apparatus. The dust separating apparatus of Korean Patent No. 623916 has a filter that is screened by a grill which supports the filter, and the filter is inseparable from the dust separating apparatus. However, for both dust separating apparatuses, the filter is often blocked by large particles of dust. Thus, the filtering of small particles of dust deteriorates. Also, if the filter is blocked by dust, the suction motor becomes overloaded thereby shortening its lifespan. Accordingly, a user has to empty the dust separating apparatus more frequently which is inconvenient. Furthermore, the user is only able to determine the degree of contamination of the filter when the filter is removed. Because the filter has to be removed, the user has to handle a dirty filter which is unpleasant, or the user has to use a tool to handle the filter which is inconvenient. Also, if the filter is inserted in a relatively narrow space, it is not easy to remove or replace the filter.

SUMMARY OF THE INVENTION

One embodiment of the present invention provides a multi-cyclone dust separating apparatus. The multi-cyclone dust separating apparatus includes a cyclone unit having a main cyclone, a secondary cyclone adapted to be disposed at substantially a same plane as the main cyclone, and a dust collecting casing adapted to substantially surround the main cyclone and the secondary cyclone, the dust collecting casing including a dust chamber to collect dust separated at the main cyclone and the secondary cyclone; and a separable filter assembly adapted to be disposed at least partially in a discharge path of the cyclone unit.

Another embodiment of the present invention provides a vacuum cleaner. The vacuum cleaner includes a main cleaner body; a suction motor adapted to be disposed at the main cleaner body; a cyclone unit adapted to be disposed at the main cleaner body, the cyclone unit having a main cyclone, a secondary cyclone adapted to be disposed on substantially the same plane as the main cyclone, and a dust collecting casing adapted to substantially surround the main cyclone and the secondary cyclone, the dust collecting casing having a dust chamber to collect the dust separated at the main cyclone and the secondary cyclone; and a separable filter assembly disposed in a discharge path between the cyclone unit and the suction motor.

Yet another embodiment of the present invention provides a filter assembly for a dust separating apparatus of a vacuum cleaner. The filter assembly includes a filter casing, including a top opening; a filter casing cover adapted to be removably mounted to the top opening, the filter casing cover being adapted to be in fluid communication with the dust separating apparatus; and at least one filter disposed at the filter casing, wherein at least one of the filter casing and the filter casing cover is made from a substantially transparent material.

BRIEF DESCRIPTION OF THE DRAWINGS

These and/or other aspects and advantages of the invention will become apparent and more readily appreciated from the following description of the embodiments, taken in conjunction with the accompanying drawings of which.

Throughout the drawings, like reference numerals will be understood to refer to like parts, components and structures.

DETAILED DESCRIPTION OF THE INVENTION

Hereinafter, a multi-cyclone dust separating apparatus, having a filter assembly, according to certain exemplary embodiments of the present invention will be described in detail with reference to the accompanying drawings.

Figure 1:
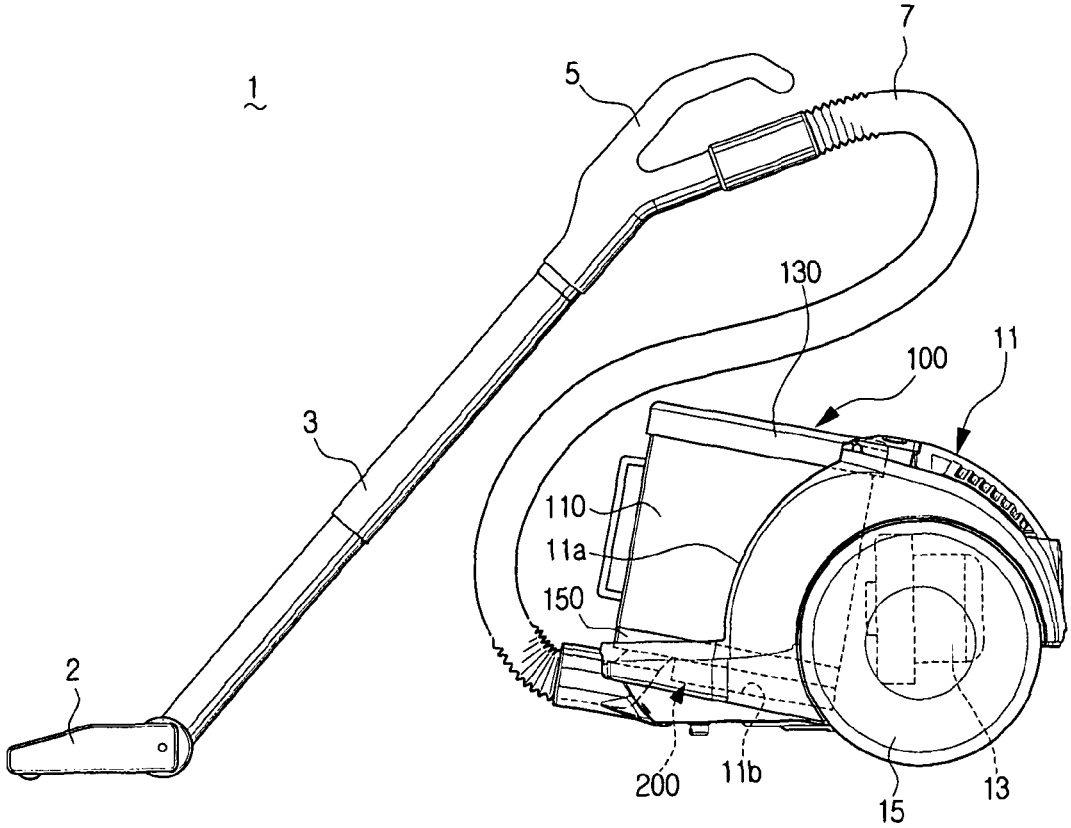
FIG. 1 is an elevation view illustrating a vacuum cleaner employing a multi-cyclone dust separating apparatus according to an embodiment of the present invention.

Referring to FIG. 1, a multi-cyclone dust separating apparatus 100 according to an embodiment of the present invention is shown. The multi-cyclone dust separating apparatus 100 is detachably attached to a main cleaner body 11 of a vacuum cleaner 1. The vacuum cleaner 1 may include a suction nozzle 2 to draw in dust from surface being cleaned, an extension pipe 3, a handle 5, a connecting hose 7, the main cleaner body 11, a suction motor 13 and a wheel 15. The main cleaner body 11 may have a dust collecting casing accommodating portion 11*a* and a seating space 11*b*.

Figure 2:
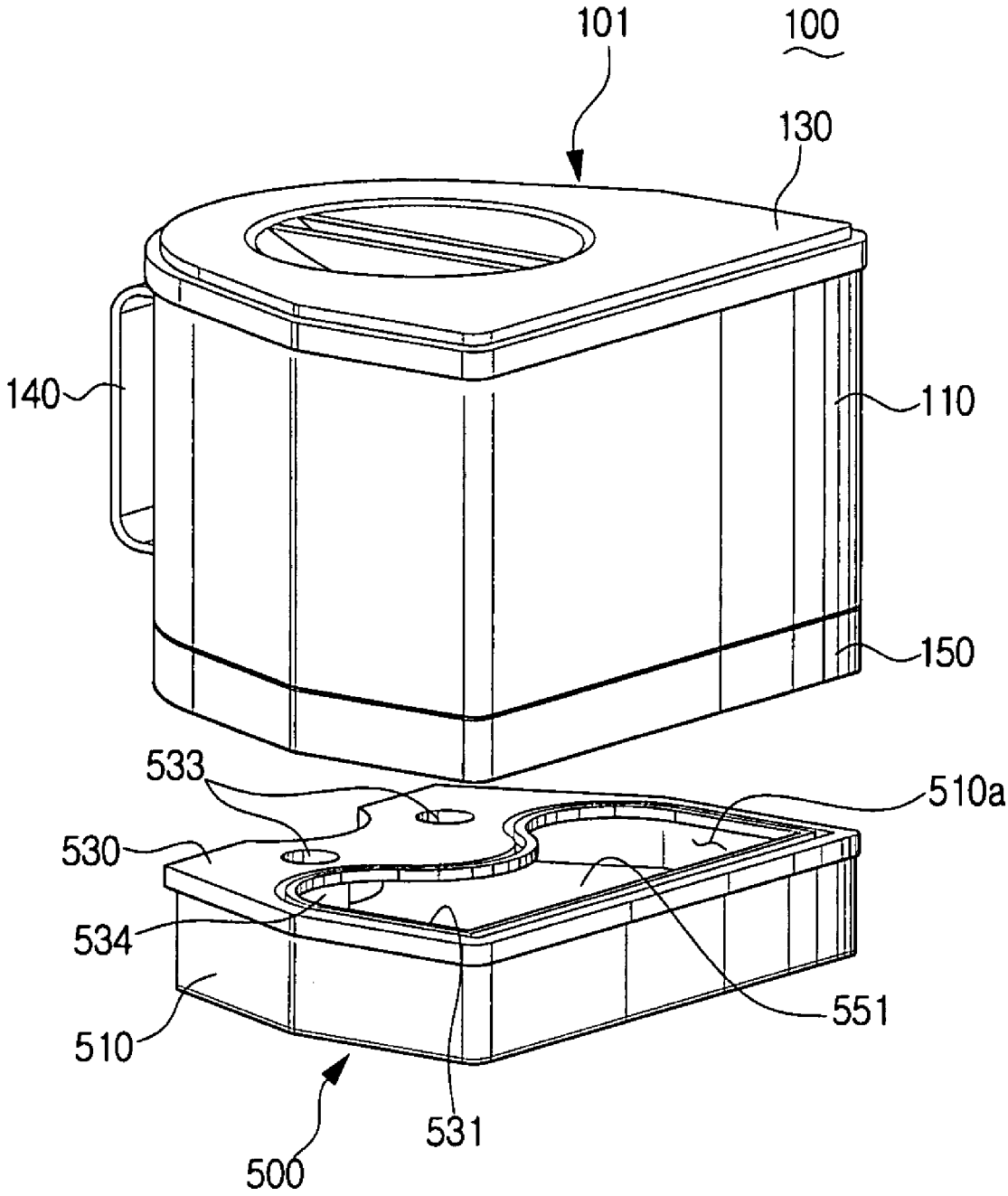
FIG. 2 is a perspective view illustrating a multi-cyclone dust separating apparatus according to an embodiment of the present invention.

Referring to FIG. 2, the multi-cyclone dust separating apparatus 100 may include a cyclone unit 101 and a filter assembly 500. The cyclone unit 101 may include one or more of a cyclone body 110, an upper cover 130, and a lower guide cover 150. The filter assembly 500 may include a filter casing 510, a filter casing cover 530, a passing hole 531, a grip holes 533, a first support protrusion 534, and a first filter 551. The filter assembly 500 may be provided separately from the cyclone unit 101. The filter assembly 500 may be detachably coupled with the lower end of the lower guide cover 150. The filter assembly 500 may be in tight contact with the lower guide cover 150 to form a sealed coupling between the lower guide cover 150 and the passing hole 531. The filter assembly 500 may be arranged on a discharge path between the cyclone unit 101 and the suction motor 13 (shown in FIG. 1).

The grip holes 533 may be recessed into the filter casing cover 530. They may be disposed on the filter casing cover 530 in a substantially symmetrical relation to each other. The first support protrusion 534 may be provided extending downward from the grip holes 533. The first support protrusion 534 may provide support for the upper side of the first filter 551.

The filter casing 510 may be removably mounted in the seating space 11*b* (shown in FIG. 1) of the main cleaner body 11. The seating space 11*b* may be inclined downward from the front toward the back of the main cleaner body 11, thereby causing the filter assembly 500 and the cyclone unit 101 mounted on top of the filter assembly 500 to be arranged at an inclination. Therefore, the user may conveniently draw out the cyclone unit 101 by using a handgrip 140 disposed on the cyclone unit 101, especially when the user is positioned above the main cleaner body 11.

Figure 3:
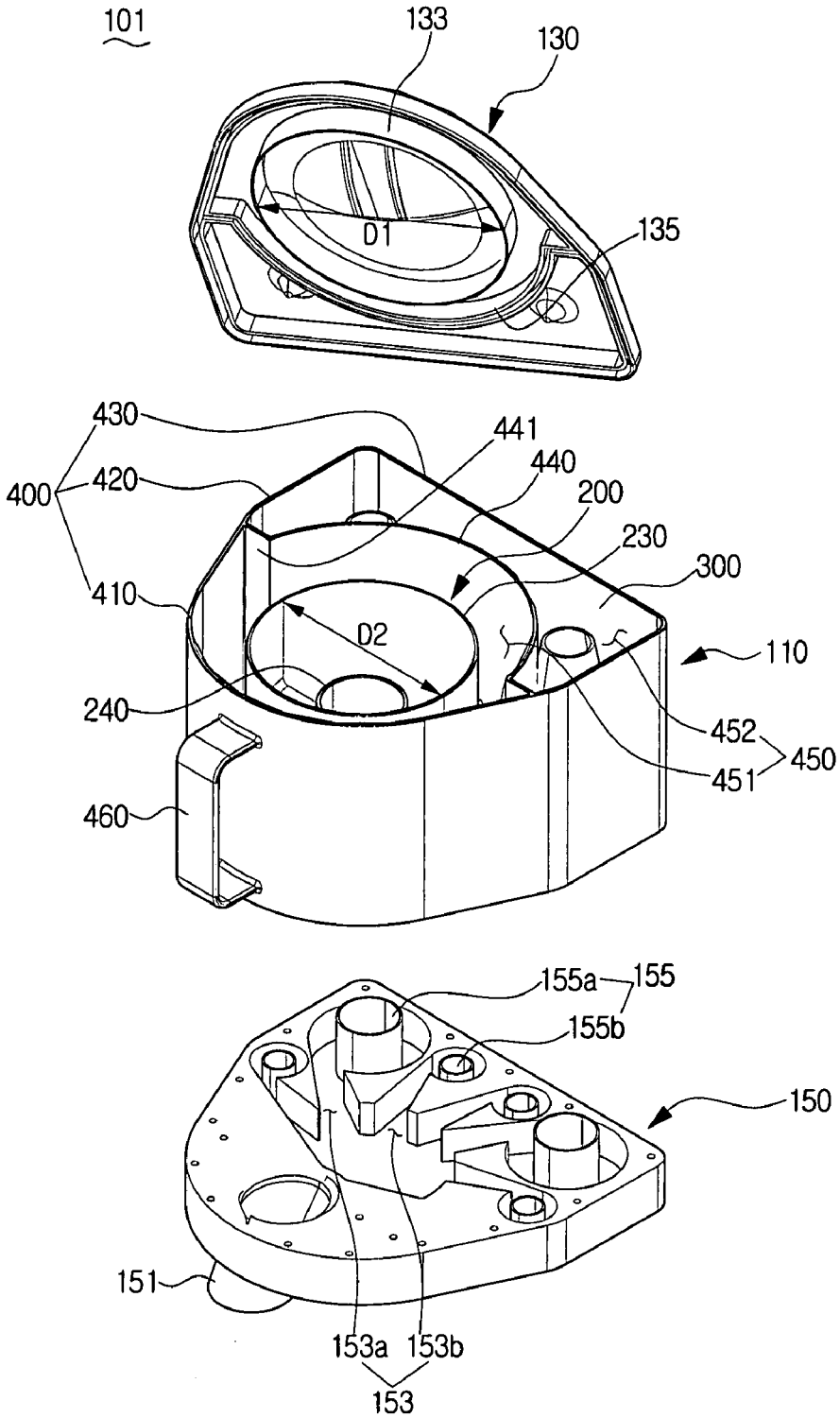
FIG. 3 is an exploded perspective view of a cyclone unit of the multi-cyclone dust separating apparatus illustrated in FIG. 2.

Referring to FIG. 3, the cyclone body 110 may include a main cyclone 200, a secondary cyclone 300 and a dust collecting casing 400. The main cyclone 200 first separates the dust from the air by centrifugal force. Accordingly, most of the relatively large particles of dust may be separated from the air in the main cyclone 200. The secondary cyclone 300 may secondarily separate the dust from the air by centrifugal force.

Accordingly, small particles of dust, which may have been unfiltered in the main cyclone 200, may be filtered in the secondary cyclone 300.

The main cyclone 200 may include an outer chamber wall 230 and/or an air discharge pipe 240. The outer chamber wall 230 may be configured in a substantially cylindrical shape that is adapted to cause the air to form a vortex. The outer chamber wall 230 may be slightly shorter than the dust collecting casing 400. The air discharge pipe 240 may be disposed substantially in the center of the outer chamber wall 230.

The dust collecting casing 400 may be adapted to surround the main cyclone 200 and the secondary cyclone 300. The dust collecting casing 400 may include the dust chamber 450 in which the dust separated from the air at the main cyclone 200 and the secondary cyclone 300 may be collected. The dust chamber 450 may include a main dust chamber 451 and a secondary dust chamber 452. The main dust chamber 451 may collect the dust separated in the main cyclone 200. The secondary dust chamber 452 may collect the dust separated from the secondary cyclone 300.

The dust collecting casing 400 may include a first wall 410, a second wall 420, and a third wall 430. The first wall 410 may be disposed in a substantially semicircular arrangement. The second wall 420 may extend from a first end of the first wall 410. The second wall 420 may be disposed in a substantially straight arrangement. Another second wall 420 may extend from a second end of the first wall 410. The third wall 430 may then be formed between the second walls 420. The length of the third wall 430 may be substantially the same as the distance between the first and second ends of the first wall 410. The first wall 410, the second wall 420, and the third wall 430 may be integrally formed with each other. The dust collecting casing 400 may be configured so that its shape substantially conforms to the contours of the dust collecting casing accommodating portion 11*a* (FIG. 1) of the main vacuum cleaner body 11.

The first wall 410 may partially surround the main cyclone 200 and may partially form the main dust chamber 451. A handgrip 460 may be formed on the first wall 410. The second wall 420 and third wall 430 may partially surround the secondary cyclone 300 and may partially form the secondary dust chamber 452.

A partition 440 is disposed within the first wall 410. The partition 440 may be disposed in a substantially semicircular arrangement. The partition 440 may be provided at a distance away from the main cyclone 200. Because the main cyclone 200 filters larger particles of dust than the secondary cyclone 300, the main dust chamber 451 may be sized as large as possible. Thus, the partition 440 should be disposed so that the semicircular arrangement curves away from the first wall 410 to provide more room for the main dust chamber 451. Opposite ends 441 of the partition 420 may be bent partially and connected with the first wall 410.

The main cyclone 200, the secondary cyclone 300, and the dust chamber 450 are disposed in the dust collecting casing 400 on substantially the same horizontal plane in relation to each other. As a result, the dust chamber 450 may hold more dust, while not increasing the overall height of the multi-cyclone dust separating apparatus 100. The capacity of the dust chamber 450, in particular, and the capacity of the first dust chamber 451 increases without requiring the size of the main vacuum cleaner body 11 (shown in FIG. 1) to increase. Additionally, because the dust chamber 450 is arranged on substantially the same plane as the main cyclone 200 and the secondary cyclone 300, overall height of the multi-cyclone dust separating apparatus 100 can be reduced, and thus, the multi-cyclone dust separating apparatus 100 may be more compact. Because the multi-cyclone dust separating apparatus 100 may be more compact the vacuum cleaner with the multi-cyclone dust separating apparatus 100 can also be more compact.

The upper cover 130 is detachably coupled to the upper end of the dust collecting casing 400. Thus, the user may easily separate the upper cover 130 to access the interior of the dust collecting casing 400 for repair or emptying the dust collecting casing 400. As mentioned above, the upper end of the outer chamber wall 230 may be lower than the upper end of the dust collecting casing 400. Accordingly, a dust discharge port 131 (shown in FIG. 7) is defined between the inner surface of the upper cover 130 and the upper end of the outer chamber wall 230, when the upper cover 130 is coupled to the upper end of the dust collecting casing 400.

A backflow inhibitor 133 may extend from the inner surface of the upper cover 130. The backflow inhibitor 133 may prevent dust held inside the first dust chamber 451 from flowing back into the outer chamber wall 230. The backflow inhibitor 133 is sized such that it has a diameter D1 greater than a diameter D2 of the outer chamber wall 230. Additionally, a sealing member 135 may extend from the inner surface of the upper cover 130 and engage with the upper end of the partition 440 to isolate the main dust chamber 451 from the secondary dust chamber 452.

At the lower end of the dust collecting casing 400, the lower guide cover 150 may be detachably coupled. An air input port 151 may be formed at a side of the lower guide cover 150, in fluid communication with a main air inlet 210 (shown in FIG. 5) of the main cyclone 200. The air input port 151 is in fluid communication with the suction nozzle 2 (shown in FIG. 1) of the vacuum cleaner 1.

An input guide path 153 may be formed at other side of the lower guide cover 150, in fluid communication with the main air outlet 220 (shown in FIG. 5) of the main cyclone 200. The input guide path 153 may be in fluid communication with the secondary cyclone 300. The secondary cyclone 300 may include a first cyclone 310 (shown in FIG. 4) and a second cyclone 320 (shown in FIG. 4). The guide path 153 may then be in fluid communication with a first cyclone inlet 312 (shown in FIG. 5) of the first cyclone 310 and a second cyclone inlet 322 (shown in FIG. 5) of the second cyclone 320. The input guide path 153 may include a first input guide path 153*a* fluidly communicating with the first cyclone inlet 312 and a second input guide path 153*b* fluidly communicating with the second cyclone inlet 322. Each of the input guide paths 153*a* and 153*b* may include a substantially helical region, such that the air discharged from the main air outlet 220 (shown in FIG. 5) is guided to flow into the first cyclone 310 and the second cyclone 320 in a vortex. An output guide path 155 with a tubular form may be provided. The air from the first cyclone 310 and the second cyclone 320 may be discharged through the output guide path 155. The upper end of the output guide path 155 may be partially inserted into the first cyclone 310 and the second cyclone 320 to prevent the cleaned air from mixing with the newly drawn air inside the cyclones 310 and 320. The output guide path 155 may include a first output guide path 155*a* to discharge air from the first cyclone 310 and a second output guide path 155*b* to discharge air from the second cyclone 320.

Figure 4:
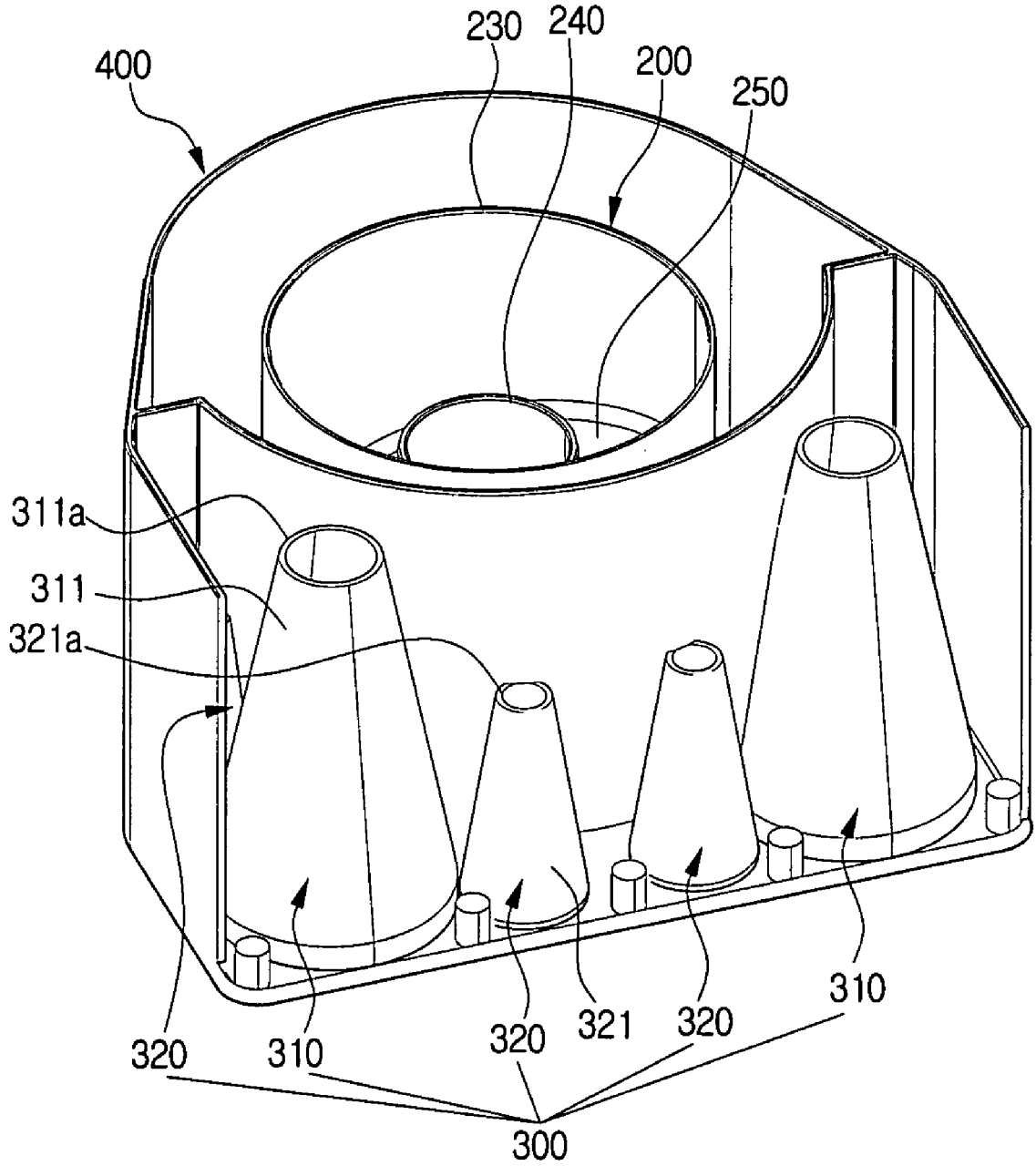
FIG. 4 is a perspective view of a dust collecting casing of the cyclone unit illustrated in FIG. 3.

Referring to FIG. 4, the secondary cyclone 300 may be substantially on the same plane as the main cyclone 200. The secondary cyclone 300 may include one or more first cyclones 310 and one or more second cyclones 320. A plurality of first cyclones 310 and a plurality of second cyclones 320 may be provided within the dust collecting casing 400. In the embodiment depicted, the secondary cyclone 300 has two first cyclones 310 and four second cyclones 320. The number of first cyclones 310 and second cyclones 320 is exemplary only and not meant to be limiting. The number of first cyclones 310 and second cyclones 320 may be greater than or less than the two first cyclones 310 and four second cyclones 320 depicted. The second cyclone 320 may be smaller than the first cyclone 310, either in height, diameter, volume, or some combination of the previous. The varying size of the first cyclones 310 and the second cyclones 320 allows for an arrangement in the dust collecting casing 400 that may maximize dust collecting efficiency and space utilization. Because of their different sizes, the first cyclones 320 and second cyclones 330 may be disposed according to the available interior space of the dust collecting casing 400.

The first cyclone 310 has a body 311 and a top 311*a*. The first cyclone 310 may be formed with a substantially conical configuration such that the body 311 may have a gradually decreasing diameter towards the top 311*a*. The body 311 may have the first cyclone inlet 312 (shown in FIG. 5) at its bottom. Both the top 311*a* and the first cyclone inlet 312 may be open. The second cyclone 320 has a body 321 and a top 321*a*. The second cyclone 320 may be formed with a substantially conical configuration such that the body 321 may have a gradually decreasing diameter towards the top 321*a*. The body 321 may have the second cyclone inlet 322 (shown in FIG. 5) at its bottom. Both the top 321*a* and the second cyclone inlet 322 may be open. A vortex of air is generated in the first cyclones 310 and the second cyclones 320 so that dust is separated from the air by centrifugal force. The dust may then be discharged through the tops 311*a* and 321*a*. The air may then move downwards to exit from the first cyclones 310 and the second cyclones 320.

The air discharge pipe 240 may be in fluid communication with the main air outlet 220 (shown in FIG. 5) at its lower end. An upwardly-extending helical air guide member 250 may be provided between an outer surface of the air outlet 240 and an inter surface of the outer chamber wall 230. The upwardly-extending helical air guide member 250 may cause air entering the main cyclone 200 to rise upward with a whirling current. Thus, dust may be separated from the air within the outer chamber wall 230.

Figure 5:
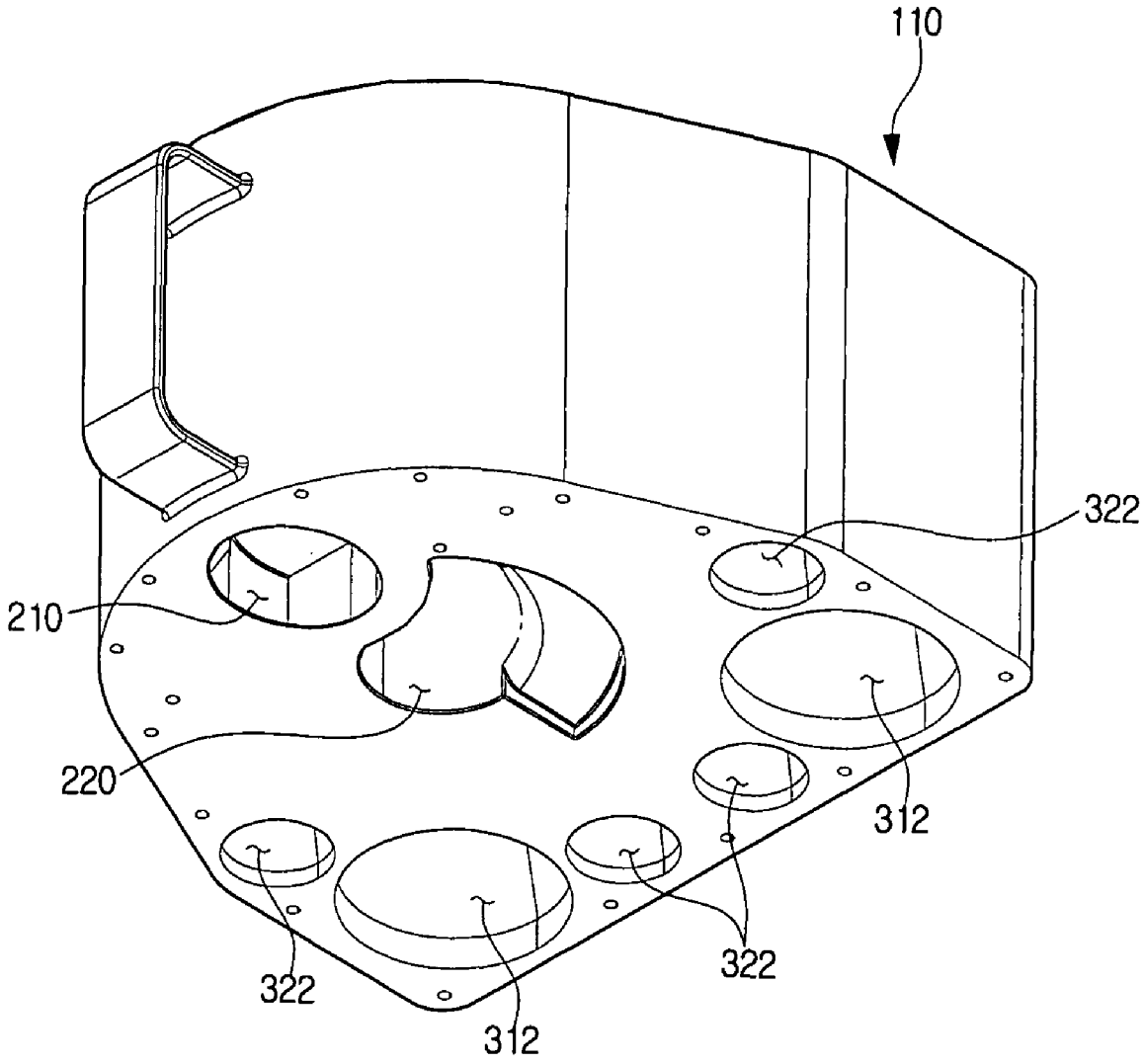
FIG. 5 is a bottom perspective view of a cyclone body of the cyclone unit illustrated in FIG. 3.

Referring to FIG. 5, the main cyclone 200 may include a main air inlet 210 and a main air outlet 220 formed at its lower end. The main air inlet 210 and the main air outlet 220 at the lower end of the main cyclone 200 may be adjacent to each other and may be formed on the same plane. Although the above exemplary embodiment explains that the main cyclone 200 has one cyclone, the number of cyclones in the main cyclone 200 is not intended to be limiting. For example, the main cyclone 200 may employ two or more cyclones.

As illustrated, the first cyclone inlets 312 and the second cyclone inlets 322 may be formed on substantially the same plane. Because the first cyclone inlet 312 and the second cyclone inlet 322 are on substantially the same plane as the main air outlet 220 of the main cyclone 200, air may move from the main cyclone 200 to the first and second cyclone cones 310 and 320 in the shortest possible distance. If the distance is minimized, suction loss while the air travels can be minimized. The air discharged from the main air outlet 220 of the main cyclone 200 may be distributed into the first cyclones 310 and the second cyclones 320 through the first cyclone inlets 312 and the second cyclone inlets 322.

The lower guide cover 150 may be detachably coupled to the lower end of the dust collecting casing 400. The air input port 151 (shown in FIG. 3) may be in fluid communication with the main air inlet 210 of the main cyclone 200. The air input port 151 (shown in FIG. 3) may also be in fluid communication with the suction nozzle 2 (shown in FIG. 1) of the vacuum cleaner 1. The input guide path 153 (shown in FIG. 3) may be in fluid communication with the main air outlet 220 of the main cyclone 200, the first cyclone inlets 312, and the second cyclone inlets 322.

Figure 6:
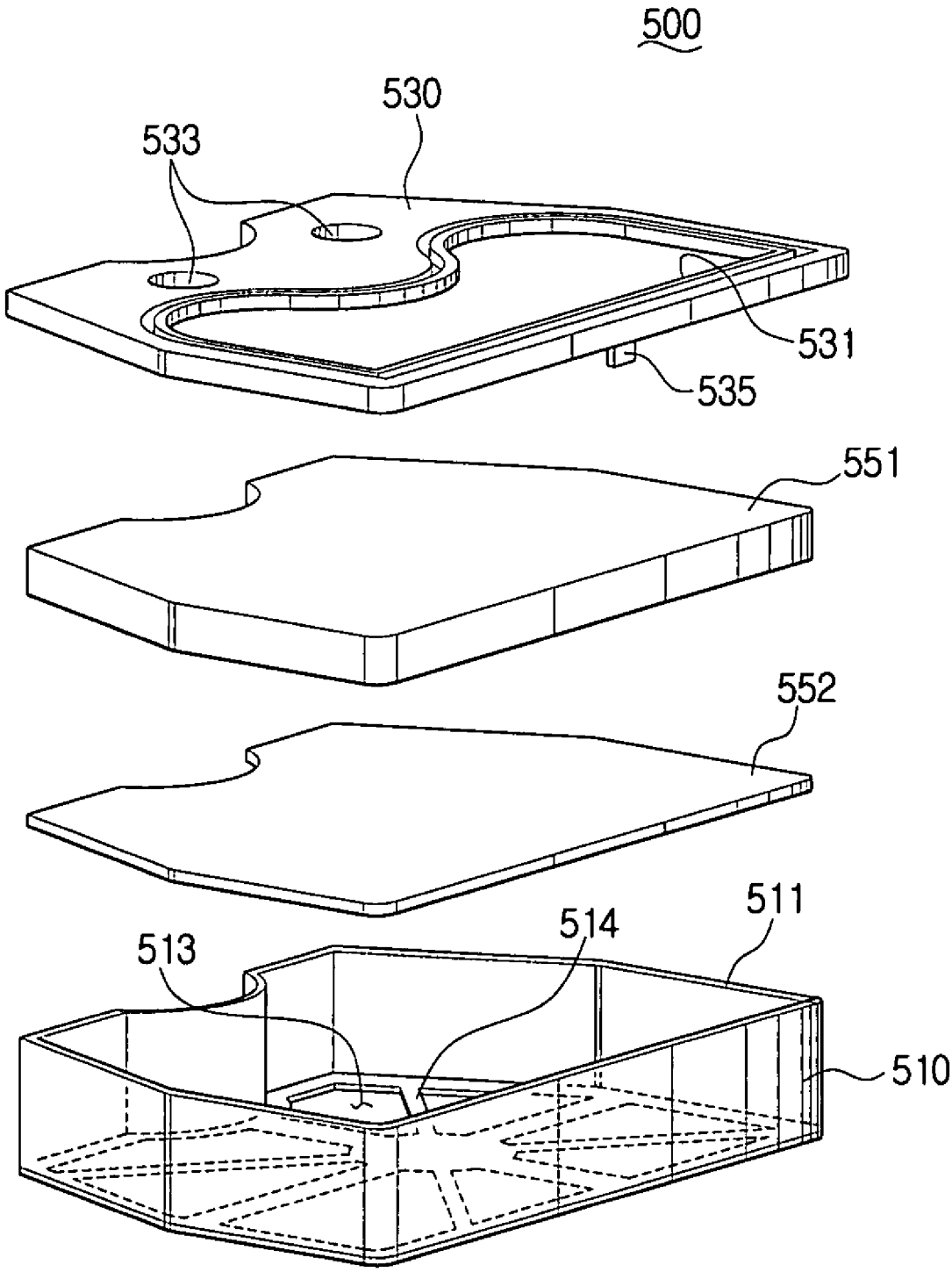
FIG. 6 is an exploded perspective view of a filter casing of the cyclone unit illustrated in FIG. 2.

Referring to FIG. 6, the filter assembly 500 may include the filter casing 510, the first filter 551, a second filter 552, and the filter casing cover 530. The filter casing 510 may be open at the top. An upper edge 511 of the filter casing 510 may be substantially horizontal with respect to the filter assembly 500. The filter casing 510 may hold the first filter 551 and the second filter 552. The filter casing 510 may also include a discharge hole 513 at a lower portion through which air is discharged. At least one filter mount 514 disposed across the discharge hole 513 to support a lower side of the second filter 552. The filter casing 510 may be made from a transparent material to allow a visual determination of the degree of contamination of the first filter 551 and the second filter 552.

The filter casing cover 530 may be detachably coupled with the upper end of the filter casing 510. The filter casing cover 530 may be made from a transparent material to allow visual determination of the degree of contamination at the first filter 551. The filter casing cover 530 may include a passing hole 531 in fluid communication with the output guide path 155 (shown in FIG. 3). The filter casing cover 530 and the lower guide cover 150 may be in tight contact with each other, thereby maintaining a sealed coupling between the output guide path 155 and the passing hole 531. A second support protrusion 535 may be provided on the filter casing 530 opposite to the grip holes 533. The second support protrusion 535 may extend downward to a depth substantially the same as the lower end of the first support protrusion 534. The second support protrusion 535 may be disposed at a distance away from the first support protrusion 534. The first support protrusions 534 and the second support protrusions 535 may support the upper side of the first filter 551 to restrain the first filter 551 and the second filter 552 within the filter casing 530.

The first filter 551 may be a sponge filter. The outer perimeter of the first filter 551 may be shaped to conform to the inner perimeter of the filter casing 510. The second filter 552 may be a high efficiency particulate air filter (HEPA), which is capable of filtering the minute dust that is unfiltered by the first filter 551. The second filter 552 may be thinner than the first filter 551. Like the first filter 551, the outer perimeter of the second filter 552 may be shaped to conform to the inner perimeter of the filter casing 510. The first filter 551 and the second filter 552 may be configured to have thicknesses such that when the first filter 551 and the second filter 552 are inserted into the filter casing 510, the upper surface of the filter 551 is gently pressed by the first support protrusion 534 and the second support protrusion 535 of the filter casing cover 530. Because the dust is filtered in two stages by the first filter 551 and the second filters 552, dust separating efficiency is increased.

In the multi-cyclone dust separating apparatus 100 according to the above exemplary embodiment of the present invention, when a user draws out the cyclone unit 101 from the dust collecting casing accommodating portion 11*a* (shown in FIG. 1) of the main cleaner body 11 to empty the cyclone unit 101, the user can determine the degree of contamination of the first filter 551 through the filter casing cover 530 of the filter assembly 500. Also, the user can determine the degree of contamination of the second filter 552 stacked below the first filter 551, by gripping the filter casing cover 530 by the grip holes 533 and pulling out the filter casing cover 530 from the seating space 11*b*. Thus, the user can determine when to replace the filters 551 and 552, and if necessary, the user can replace the filters 551 and 552.

Figure 7:
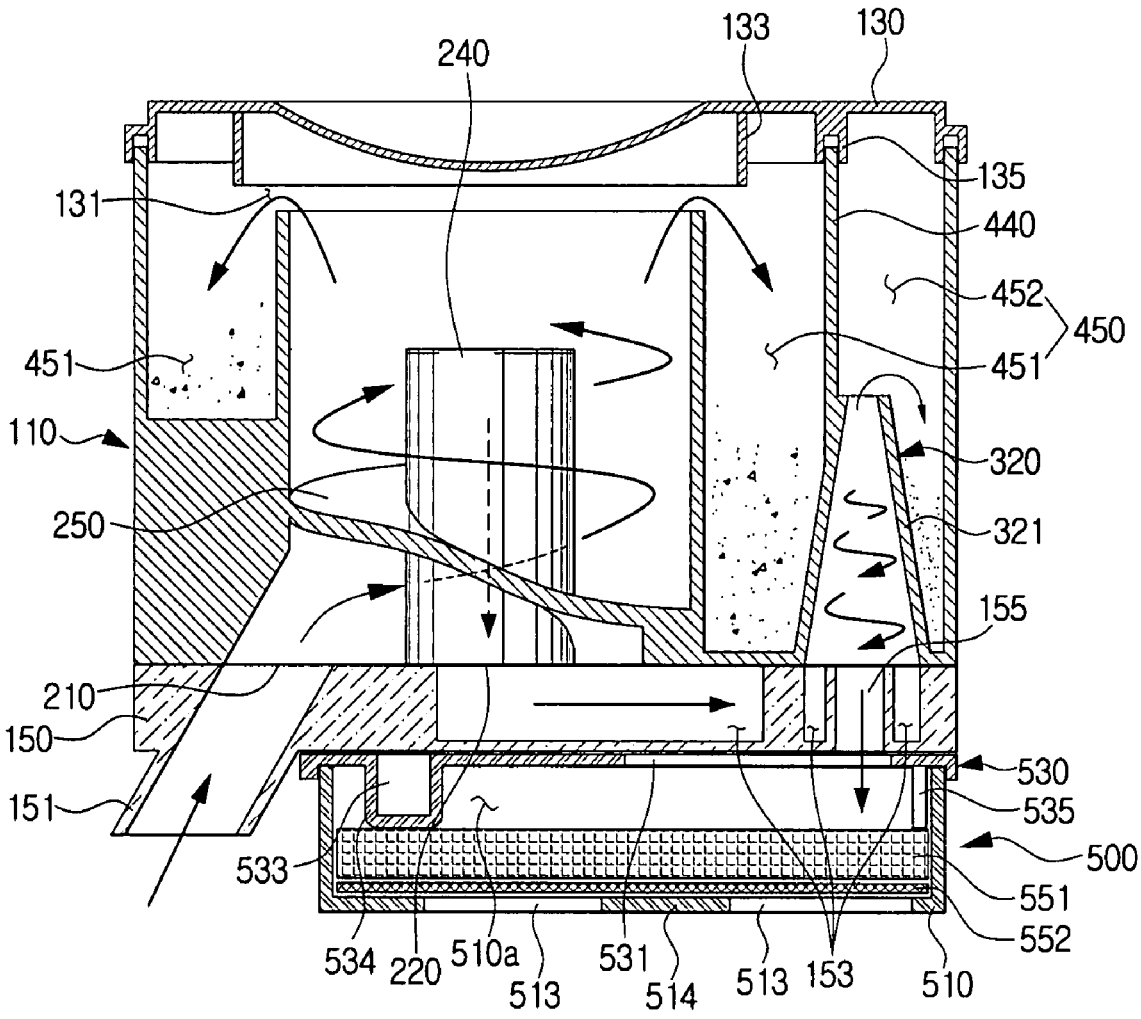
FIG. 7 is a sectional view of the multi-cyclone dust separating apparatus illustrated in FIG. 1.

Referring to FIG. 7, the filter casing 510 defines a dust piling space 510*a* at an approximately upper part therein above the first and second filters 551 and 552. Although the filter assembly 500 is described as being below the cyclone unit 101, the description is not intended to be limiting because the filter assembly 500 may be provided elsewhere. The filter assembly 500 may also be arranged above or on the side of the cyclone unit 101 so that it is in fluid communication with the output guide path 155.

When suction is applied to the multi-cyclone dust separating apparatus 100, air and dust enter through the air input port 151. The air input port 151 may be formed at a side of the lower guide cover 150. Because the air input port 151 may be in fluid communication with the main air inlet 210, the dust and air may enter the main cyclone 200. The upwardly-extending helical air guide member 250 may cause the air and dust to move in a rising, whirling current. Because the air is whirling, relatively large sized dust is separated from the air by centrifugal force. The separated dust may be collected in the main dust chamber 451. The air may then flow through the discharge pipe 240 to the main air outlet 220. The air may then enter the input guide path 153 of the lower guide cover 150. The air may then enter the first cyclone 310 through the first cyclone inlet 312. The air may also enter the second cyclone 320 through the second cyclone inlet 322. The air may then form a vortex in the first cyclone 310 and the second cyclone 320. The whirling of the air may separate dust from the air by centrifugal force. The separated dust may then be collected in the secondary dust chamber 452. The air may then flow through the output guide path 155 to the filter assembly 500. The air may enter the filter assembly 500 through the passing hole 531. The air may then be filtered by the first filter 551 and the second filter 552 before it is discharged through the discharge hole 513.

According to the exemplary embodiment of the present invention, by providing a separately formed filter assembly 500 on the discharge path between the cyclone unit 101 and the suction motor 13, the filter assembly 500 can filter the minute dust which is not filtered by the cyclone unit 101. Therefore, minute dust is not suctioned into the suction motor 13, and thus malfunction of or damage to the suction motor 13 may be prevented.

Furthermore, because the filter assembly 500 is separately formed, the cyclone unit 101 can be emptied and the filters 551 and 552 can be replaced independently of one another. Additionally, because the filter assembly 500 is provided separately from the cyclone unit 101 where the relatively large particles of dust are filtered, blockage of the filters 551 and 552 due to the relatively large particles of dust can be avoided, and the minute dust separating efficiency can be increased.

Furthermore, the degree of contamination of the filters 551 and 552 may be visually determined when the filter assembly 500 is made from a transparent material. Also, if replacement is necessary, the replacement of the filters 551 and 552 can be more convenient.

While the specific embodiments of the present invention have been described, additional variations and modifications of the embodiments may occur to those skilled in the art once they learn of the basic inventive concepts. Therefore, it is intended that the appended claims shall be construed to include both the above embodiments and all such variations and modifications that fall within the spirit and scope of the invention.

What is claimed is:

1. A multi-cyclone dust separating apparatus, comprising:
a cyclone unit including,
a main cyclone,
a secondary cyclone adapted to be disposed at substantially a same plane as the main cyclone, and
a dust collecting casing adapted to substantially surround the main cyclone and the secondary cyclone, the dust collecting casing including a dust chamber to collect dust separated at the main cyclone and the secondary cyclone; and
a separable filter assembly adapted to be disposed at least partially in a discharge path of the cyclone unit at a lower side of the cyclone unit in fluid communication with the cyclone unit, and the filter assembly comprising a filter casing including a top opening and a bottom, a filter casing cover adapted to be removably mounted to the top opening, and at least one filter adapted to be disposed in the filter casing.

2. The multi-cyclone dust separating apparatus of claim 1, wherein the bottom is partially open.

3. The multi-cyclone dust separating apparatus of claim 1, wherein at least one of the filter casing and the filter casing cover is made from a substantially transparent material.

4. The multi-cyclone dust separating apparatus of claim 1, wherein the filter casing cover includes a passing hole in fluid communication with the secondary cyclone.

5. The multi-cyclone dust separating apparatus of claim 4, wherein the passing hole is tightly coupled to the cyclone unit.

6. The multi-cyclone dust separating apparatus of claim 1, wherein the filter casing cover filter comprises at least two grip holes disposed on the filter casing cover.

7. The multi-cyclone dust separating apparatus of claim 1, wherein the filter casing includes a dust piling space formed above the filter to collect dust.

8. The multi-cyclone dust separating apparatus of claim 1, wherein the filter casing cover further comprises:
at least one first support protrusion adapted to extend from a lower side of the filter casing cover; and
a second support protrusion adapted to extend from the lower side of the filter casing cover to substantially the same level as a lower end of the first support protrusion, the second support protrusion disposed at a predetermined distance away from the first support protrusion,
wherein the first and second support protrusions are adapted to support the upper side of the filter to substantially restrain the filter within the filter casing.

9. The multi-cyclone dust separating apparatus of claim 1, wherein the filter comprises at least one of a sponge filter and a micro filter.

10. A vacuum cleaner, comprising:
a main cleaner body;
a suction motor adapted to be disposed at the main cleaner body;
a cyclone unit adapted to be disposed at the main cleaner body, the cyclone unit including,
a main cyclone,
a secondary cyclone adapted to be disposed on substantially the same plane as the main cyclone, and
a dust collecting casing adapted to substantially surround the main cyclone and the secondary cyclone, the dust collecting casing having a dust chamber to collect the dust separated at the main cyclone and the secondary cyclone; and
a separable filter assembly disposed in a discharge path between the cyclone unit and the suction motor, and the filter assembly comprising a filter casing with a top opening and a bottom, a filter casing cover adapted to be removably mounted to the top opening, and at least one filter adapted to be disposed in the filter casing.

11. The multi-cyclone dust separating apparatus of claim 10, wherein at least one of the filter casing and the filter casing cover is made from a substantially transparent material.

12. The multi-cyclone dust separating apparatus of claim 10, wherein the filter casing cover includes at least one grip hole disposed at the filter casing cover.

13. The multi-cyclone dust separating apparatus of claim 10, wherein the filter casing further comprises a dust piling space formed above the filter to collect dust.

14. The multi-cyclone dust separating apparatus of claim 10, wherein the filter casing cover comprises:

at least one first support protrusion adapted to extend from a lower side of the filter casing cover; and a second support protrusion adapted to extend from the lower side of the filter casing cover to substantially the same level as a lower end of the first support protrusion, the second support protrusion disposed at a predetermined distance away from the first support protrusion, wherein the first and second support protrusions are adapted to substantially restrain the filter within the filter casing.

* * * * *